US011502385B2

(12) United States Patent
Hendry

(10) Patent No.: US 11,502,385 B2
(45) Date of Patent: Nov. 15, 2022

(54) MULTI-MODE BANDPASS FILTER

(71) Applicant: NOKIA TECHNOLOGIES OY, Espoo (FI)

(72) Inventor: David Robert Hendry, New Providence, NJ (US)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

(21) Appl. No.: 17/263,143

(22) PCT Filed: Aug. 8, 2018

(86) PCT No.: PCT/US2018/045720
§ 371 (c)(1),
(2) Date: Jan. 25, 2021

(87) PCT Pub. No.: WO2020/032939
PCT Pub. Date: Feb. 13, 2020

(65) Prior Publication Data
US 2021/0194108 A1 Jun. 24, 2021

(51) Int. Cl.
*H01P 7/10* (2006.01)
*H01P 1/20* (2006.01)
*H01P 5/08* (2006.01)

(52) U.S. Cl.
CPC ..... *H01P 7/105* (2013.01); *H01P 1/20* (2013.01); *H01P 5/08* (2013.01)

(58) Field of Classification Search
CPC ..... H01P 7/105; H01P 1/20; H01P 5/08
See application file for complete search history.

(56) References Cited

U.S. PATENT DOCUMENTS 9,406,988 B2 8/2016 Hendry et al.
9,437,910 B2 9/2016 Hendry et al.
(Continued)

FOREIGN PATENT DOCUMENTS

CN 202601816 U 12/2012
CN 104752794 A 7/2015
(Continued)

OTHER PUBLICATIONS

Office Action dated Aug. 3, 2021, in connection with Chinese Patent Application No. 2018800964621.4, 17 pgs (including translation).
International Search Report and Written Opinion dated May 16, 2019, in connection with International Patent Application No. PCT/US2018/045720, filed Aug. 8, 2018, 17 pgs.
Hendry et al., "Triple-Mode Ceramic Cavity Filters with Wide Spurious-Free Performance," 2017, IEEE Transactions on Microwave Theory and Techniques, vol. 65, No. 10, pp. 3780-3788.
(Continued)

*Primary Examiner* — Samuel S Outten
*Assistant Examiner* — Kimberly E Glenn
(74) *Attorney, Agent, or Firm* — Chiesa Shahinian & Giantomasi PC

(57) ABSTRACT

A multi-mode filter with a resonator having a plurality of resonator bodies which are rectangular prisms and the filter being configured with a through hole that electrically connects an input and an output to the center of a coupling structure between a respective pair of slabs. The multi-mode filter further comprising a plurality of coupling aperture segments which are coupling structures between each pair of resonator bodies or slabs such that two triangular apertures at opposite corners of at least two different slab-cube interfaces are utilized with the triangular apertures being diagonally opposed to one another across the respective interface.

20 Claims, 6 Drawing Sheets

(56) References Cited

U.S. PATENT DOCUMENTS

| | | | | |
|---|---|---|---|---|
| 9,614,264 | B2 | 4/2017 | Hendry et al. | |
| 9,698,455 | B2 | 7/2017 | Hendry et al. | |
| 2009/0146761 | A1 | 6/2009 | Nummerdor | |
| 2015/0380799 | A1 | 12/2015 | Cooper et al. | |
| 2015/0380800 | A1* | 12/2015 | Cooper | H01P 7/105 333/202 |
| 2016/0006104 | A1 | 1/2016 | Cooper et al. | |
| 2016/0094265 | A1 | 3/2016 | Yuan | |

FOREIGN PATENT DOCUMENTS

| | | | |
|---|---|---|---|
| CN | 104995786 | A | 10/2015 |
| WO | 2017000259 | A1 | 1/2017 |

OTHER PUBLICATIONS

Kelleci et al., "An Analytical Approach to the Design of Multiple Mode Rectangular Cavity Waveguide Filters," 2017, IEEE Transactions on Microwave Theory and Techniques, vol. 65, No. 8, pp. 2857-2865.

Yahia et al., "Complex Rectangular Filter Design using Hybrid Finite Element Method and Modified Multimodal Variational Formulation," 2013, Progress In Electromagnetics Research C, vol. 44, pp. 55-66.

Liu et al., "Ultra-Compact Highly Selective Quasi-Elliptic Filters Based on Combining Dual-Mode SIW and Coplanar Waveguides in a Single Cavity," 2018, IET Microwaves, Antennas & Propagation, vol. 12, Issue 3, pp. 360-366.

* cited by examiner

MULTI-MODE BANDPASS FILTER

CROSS-REFERENCE TO RELATED APPLICATIONS

This application is a national stage under 35 U.S.C. 371 of International Patent Application No. PCT/US2018/045720, filed Aug. 8, 2018, the disclosure of which is incorporated herein by reference in its entirety.

TECHNICAL FIELD

The present disclosure relates to filters, and more particularly, to a multi-mode bandpass filter with increased bandwidth capabilities.

BACKGROUND

Physical filters generally consist of a number of energy storing resonant structures with paths for energy to flow between these resonators and input/output ports. The physical implementation of the resonators and their respective interconnection will vary but the aforementioned principle applies equally such that these filters can be mathematically described in terms of a network of resonators coupled together.

BRIEF SUMMARY OF EMBODIMENTS

In accordance with various embodiments, an improved multi-mode bandpass filter is provided having a through hole in each of the end slabs, and two triangular apertures at opposite corners of the slab-cube interface thereby providing for increased bandwidth capabilities.

In accordance with an embodiment, a multi-mode filter comprises resonator having a plurality of resonator bodies which are rectangular prisms (i.e., cuboids). The filter is configured with a through hole that electrically connects an input and an output to the center of a so-called "bullseye" coupling structure between a respective pair of slabs. Further, the multi-mode filter also has a plurality of coupling aperture segments which are coupling structures between each pair of resonator bodies or slabs. In accordance with the embodiment, two triangular apertures at opposite corners of at least two different slab-cube interfaces with such triangular apertures being diagonally opposed to one another across the respective interface. This facilitates a structure having an end-tapped dumbbell-shaped half-wavelength low-Q resonator, thereby considerably increasing the amount of external coupling available.

These and other advantages will be apparent to those of ordinary skill in the art by reference to the following detailed description and the accompanying drawings.

DETAILED DESCRIPTION

Figure 1:
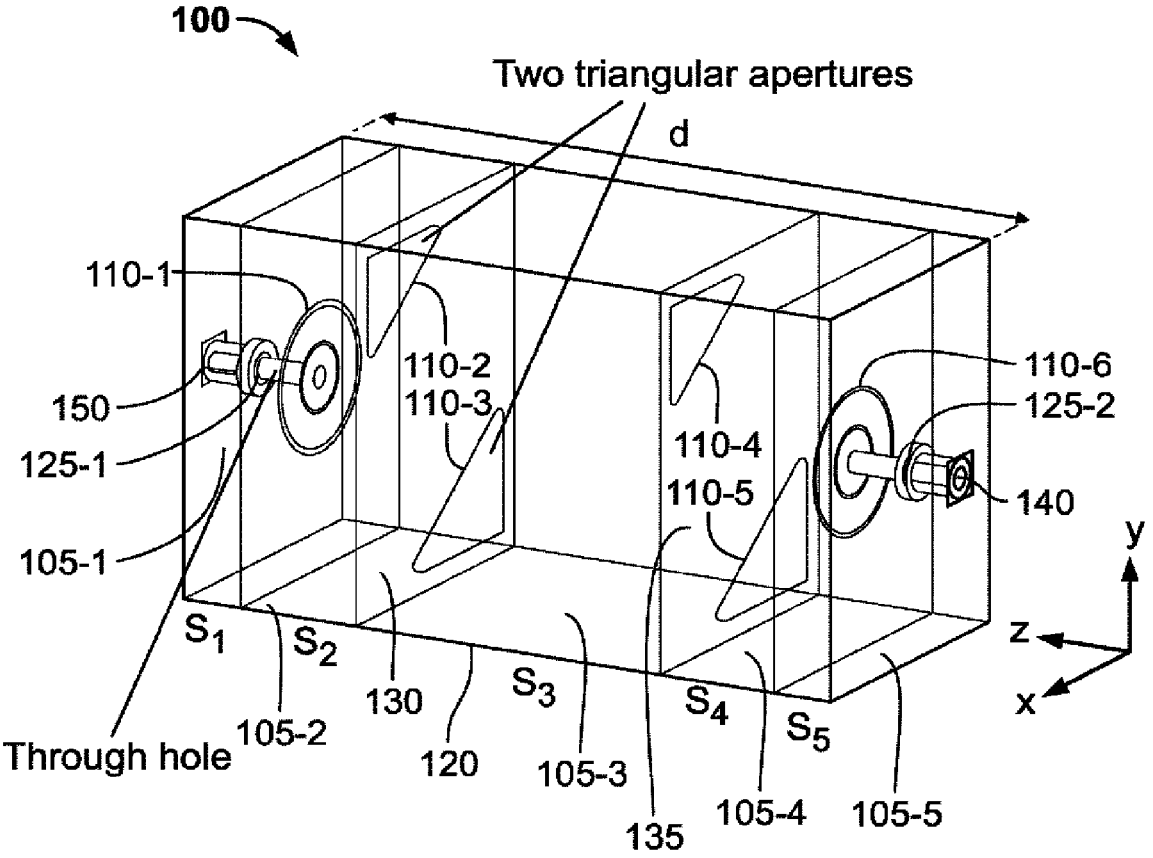
FIG. 1 shows a schematic perspective view of a multi-mode filter in accordance with an embodiment.

Some single-mode filters are typically formed from dielectric resonators having high-Q (low loss) characteristics which enable highly selective filters having a reduced size compared to cavity filters. Such single-mode filters tend to be constructed as a cascade of separated physical dielectric resonators with various couplings between them and their respective ports. Also, such single-mode filters may include a network of discrete resonators formed from ceramic material in a so-called "puck" shape, where each resonator has a single dominant resonance frequency or mode. These resonators are coupled together by providing openings between cavities in which the resonators are located. Typically, transmission poles or "zeros" are provided which can be tuned at particular frequencies to provide the desired filter response. A number of resonators will usually be required to achieve suitable filtering characteristics in commercial applications thereby resulting in relatively large size Multi-mode filters typically implement several resonators in a single physical body such that filter size reduction can be achieved and the resulting filter can resonate in many different modes. As an example, a silvered dielectric body can resonate in many different modes such that each of these modes can act as one of the resonator in the filter. In order to provide for a practical multi-mode filter it is necessary to couple the energy between the modes within the single body. A typical manner in which such multi-mode filters are implemented is to selectively couple the energy from an input port to a first one of the modes. The energy stored in the first mode is then coupled to different modes within the resonator by introducing specific defects into the shape of the body. In this way, a multi-mode filter can be implemented as an effective cascade of resonators, in a similar fashion to conventional single mode filters. This multi-mode filter design further results in transmission poles which can be tuned to provide a desired filter response.

One compact radio-frequency (RF) filter, as described in U.S. Patent Publication No. 2015/0380799 A1, includes an a multi-mode filter made from silver plated resonator pieces (i.e., single mode slabs and triple-mode cubes) that are coupled together via apertures at the interfaces. This design differs from the aforementioned multi-mode filter designs in that the modes of the multi-mode structure are assumed to be coupled in parallel from input to output, with no coupling between the modes. In this way, defects are not needed in the shape of the body and allow this filter-type to use a perfect cuboid. Transmission zeros are formed by the amplitude and phase ratios of the parallel couplings into the modes, rather than by non-adjacent cross couplings across the resonators. Further, this filter solution provides for reducing the cooling demands on active antennas, supports space efficiency, power handling and efficiency, throughput and multi-band implementations. In this way, radio equipment vendors can deploy this filter design in efforts to deal with heat, output and multi-band capability challenges faced by the vendor's base station deployments in the field. Further, this filter design employs a blind depth hole to couple externally into a first and last slab of several slabs of the filter, while three square apertures couple a slab to a cube. The deeper the blind depth hole, the more the external coupling (while the larger the apertures) and the more the slab-to-cube coupling. However, the finite limit on the hole depth and the aperture size limits the maximum bandwidth achievable to approximately 5% fractional bandwidth (i.e., 90 MHz bandwidth at 1800 MHz center frequency, or 180 MHz bandwidth at 3600 MHz).

Therefore, an improved multi-mode bandpass filter with increased bandwidth capabilities is desirable.

In accordance with various embodiments, an improved multi-mode bandpass filter is provided having a through hole in respective end slabs, and two triangular apertures at opposite corners of the slab-cube interface thereby providing for increased bandwidth capabilities.

FIG. 1 shows a schematic perspective view of a multi-mode filter 100 in accordance with an embodiment. More particularly, multi-mode filter 100 comprises resonator 120 having a plurality of resonator bodies (i.e., resonator bodies 105-1, 105-2, 105-3, 105-4, and 105-5) which are rectangular prisms (i.e., cuboids), illustratively. Resonator 120 is manufactured from a solid body of dielectric material (e.g., ceramic) having suitable dielectric properties. Also, resonator 120 can be multi-layered body including, for example, layers of materials having different dielectric properties. Resonator 120 may include an external coating of conductive material (i.e., a metallization layer) which may be made from silver or other well-known materials such as gold, copper or the like. The conductive material may be applied to one or more surfaces of the resonator, and a region of the surface, forming a coupling aperture, may be uncoated to allow coupling of signals to the body of resonator 120, as further detailed below.

Resonator bodies 105-1, 105-2, 105-3, 105-4, and 105-5 are alternatively referred to herein as "slabs" and are respectively shown in FIG. 1 as slab $S_1$, slab $S_2$, slab $S_3$, slab $S_4$, and slab $S_5$. In accordance with the embodiment, multi-mode filter 100 has an overall length d of 27 mm, and the approximate dimensions (x, y, and z) of the respective resonator bodies are: 11.575 mm×15.196 mm×2.30 mm for resonator bodies 105-1 and 105-5, 11.575 mm×15.196 mm×4.50 mm for resonator bodies 105-2 and 105-4, and 11.536 mm×15.196 mm×12.551 mm. Further, resonator bodies 105-1, 105-2, 105-3, and 105-4 are each single mode resonators, and resonator body 105-3 is a multi-mode resonator. Of course, the aforementioned dimensions are illustrative in nature and other shapes and resonator sizes are also possible in accordance with the principles disclosed herein.

As will be appreciated, the number of modes which can be supported by multi-mode filter 100 is largely a function of the shape of each resonator body. Cuboid structures are particularly advantageous given they can be manufactured easily and relatively inexpensively and such structures can be easily fitted together by arranging, for example, multiple resonator bodies in contact, as further detailed below. Further, cuboid structures typically have clearly defined resonance modes thereby making configuration of the coupling aperture arrangement easier. Additionally, the use of a cuboid structure provides a planar surface, or a face, so that the apertures can be arranged in a plane parallel to such planar surface, with the apertures optionally being formed from an absence of metallization thereon. Thus, although cubic/cuboidal resonators are the primary focus herein thereby supporting up to three (i.e., simple, non-degenerate) modes in the case of a cube or cuboid, other shapes and numbers of modes are also possible in accordance with the principles disclosed herein.

As shown, multi-mode filter 100 also has a plurality of coupling aperture segments (i.e., aperture coupling segments 110-1, 110-2, 110-3, 110-4, 110-5 and 110-6, respectively) which are coupling structures between each pair of resonator bodies or slabs. The respective apertures are constituted by an absence of metallization (each resonator body is encapsulated in a metalized layer, not shown for clarity) with the remainder of the resonator body being substantially encapsulated in its metalized layer. For example, the coupling aperture segments 110-1 through 110-6 may be formed by etching, either chemically or mechanically, the metallization surrounding the respective resonator body to remove metallization and thereby form the coupling aperture segment(s). Alternatively, the coupling aperture segments could also be formed by other mechanisms, such as producing a mask in the shape of the respective aperture and temporarily attaching the mask to the specific location on the surface on the resonator body, spraying or otherwise depositing a conductive layer (i.e., a metallized layer) across substantially all of the surface area of the resonator body and then removing the mask from the resonator thereby leaving the desired aperture in the metallization.

As shown multi-mode filter 100 has through hole 125-1 which connects input 150 to the center of aperture segment 110-1 (also referred to herein as a "bullseye" coupling structure) between the pair of slabs $S_1$ and $S_2$. Similarly, through hole 125-2 connects output 140 to the center of aperture segment 110-6 (also referred to herein as a "bullseye" coupling structure) between the pair of slabs $S_5$ and $S_4$. In this configuration, the structure of resonator 120 can be described as a so-called end-tapped dumbbell-shaped half-wavelength low-Q resonator with a considerable increase in the amount of external coupling available.

As will be appreciated, in certain scenarios, a single resonator body cannot provide adequate performance (for example, in the attenuation of out-of-band signals). As such, the filter's overall performance can be improved by providing two or more resonator bodies arranged in series to facilitate increased filter performance such as the configuration in multi-mode filter 100. Consider, for example, a general case of arbitrary formed electric field (E-field) and magnetic field (H-field) that are typically present immediately outside a resonator body employing a single-mode resonator (e.g., resonator body 105-1/Slab $S_1$, as described above) used on the input side as an illuminator to contain the fields to be coupled into a multi-mode resonator body (e.g., resonator body 105-3/Slab $S_3$, as described above). As used herein, the term "illuminator" refers to any object, element, or the like which can contain or emit E-fields, H-fields or both types of such fields. That is, in the general case, consider the E-fields and H-fields existing in the single-mode resonator (e.g., resonator body 105-1/Slab $S_1$, as described above) where such fields are to be coupled into the multi-mode resonator body (e.g., resonator body 105-3/Slab $S_3$, as described above) via one or more arbitrarily-shaped coupling apertures. The shape of the multi-mode resonator will result in arbitrarily-shaped field orientations being required within the multi-mode resonator to excite the resonator modes (e.g., X, Y, and Z modes). As such, the field orientations of both the multi-mode resonator and the illuminator are important in determining the degree of coupling achieved together with the shape, size and orientation of the coupling apertures.

The illuminator contains one or more modes, each with its own field pattern as with the multi-mode resonator and the set of coupling apertures which also have a series of modes with their own field patterns. The coupling apertures from a given illuminator mode to a given aperture mode will be determined by the degree of overlay between the illuminator and aperture field patterns. Likewise, the coupling from a given coupling aperture mode to a given multi-mode resonator mode will be given by the overlap between the aperture and the multi-mode resonator field patterns. The coupling from a given illuminator mode to a given multi-mode resonator mode will therefore be the phasor sum of the couplings through all the aperture modes. The result of which is that the vector component of the H-field aligning with the aperture and then with the vector component of the resonator mode, along with the aperture size, determines the strength of the coupling. If all of the vectors align then strong coupling will generally occur, and likewise if there is misalignment then the degree of coupling is reduced. Further, in the case of the E-field, it is mainly the cross-sectional area of the aperture and its location on the face of the resonator which is important in determining the coupling strength. Thus, it is possible to control the degree of coupling to the various modes within the multi-mode resonator and, consequently, the pass-band and stop-band characteristics of the resulting filter.

That is, the aforementioned control of the degree of coupling may be obtained in each filter mode by controlling at least the length, width, position of the aperture arrangement and the angle thereof relative to the edges of the cuboid. In this way, in accordance with the embodiment shown in FIG. 1, aperture segments 110-2, 110-3, 110-4 and 110-5 are configured in a specific size and orientation to achieve improved coupling characteristics between resonator body 105-3/Slab $S_3$ (the multi-mode filter) and the adjacent single mode filters (i.e., resonator body 105-2/Slab $S_2$ and resonator body 105-4/Slab $S_4$, respectively) thereby increasing the bandwidth of multi-mode filter 100. More particularly, as shown in FIG. 1, two triangular apertures at opposite corners of each slab-cube interface (i.e., interface 130 and interface 135) are employed with aperture segment 110-2 and aperture segment 110-3 configured in interface 130 (i.e., the slab-cube interface between Slab $S_2$ and Slab $S_3$) with such triangular apertures being diagonally opposed to one another, and aperture segment 110-4 and aperture segment 110-5 configured in interface 135 (i.e., the slab-cube interface between Slab $S_3$ and Slab $S_4$) with such triangular apertures being diagonally opposed to one another. It will be noted that while shown in the upper left and bottom right (i.e., opposite corners of the slab-cube interface with diagonally opposing aperture elements) this is one possible configuration among others that are equally consistent with the disclosed principles herein.

Figure 2:
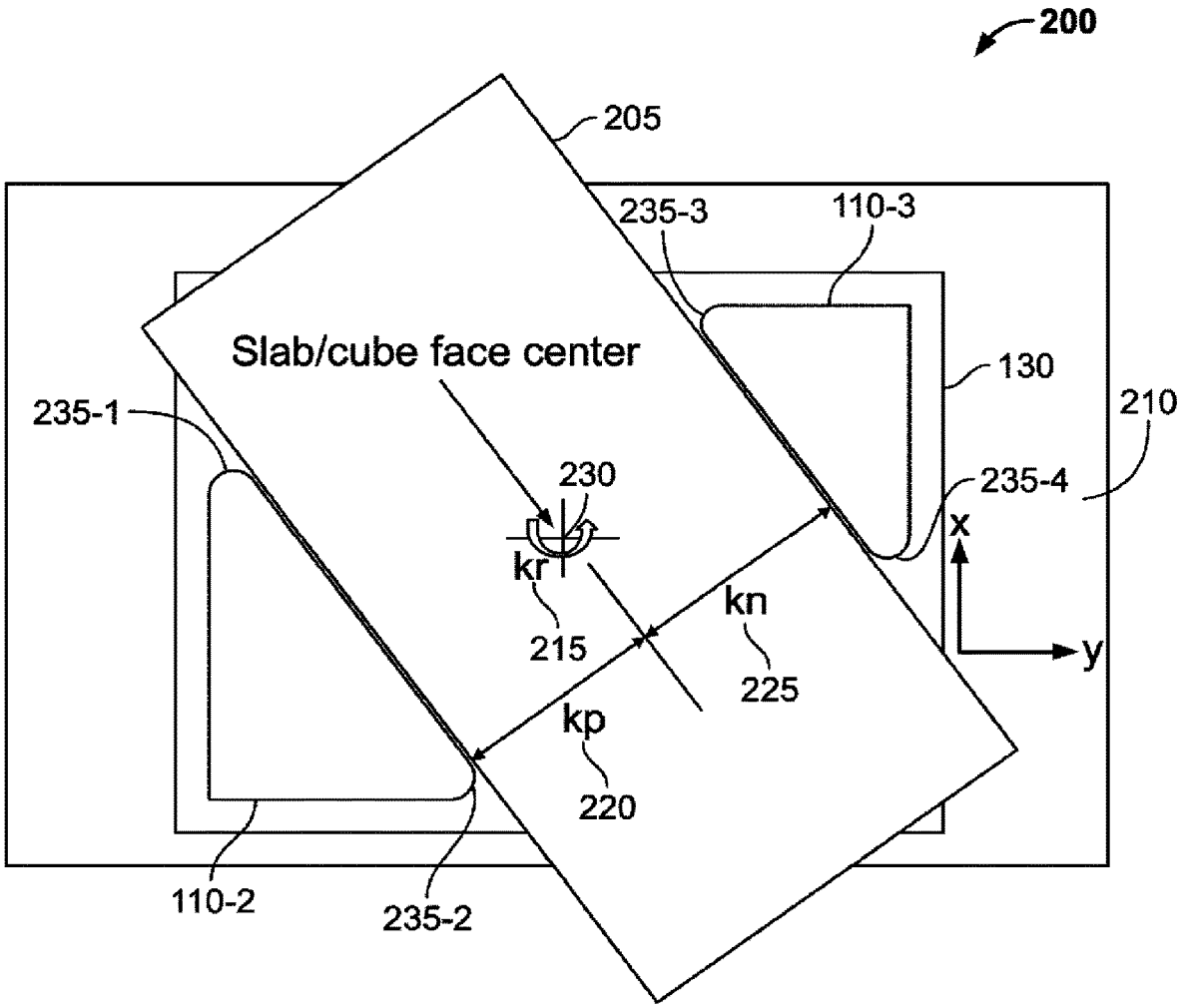
FIG. 2 illustrates an aperture calculation and configuration for the multi-mode filter in FIG. 1 in accordance with an embodiment.

Mathematically speaking, these pairs of triangular apertures are determined by subtracting a rotated rectangle from a larger rectangle that fills the interface, for example, interface 130 and/or interface 135. FIG. 2 illustrates an aperture calculation and configuration in accordance with the embodiment. As shown, configuration 200 includes rotated rectangle 205 that has been subtracted from rectangle 210 (which is larger than rotated rectangle 205) and which fills, for example, interface 130. Note four of the six corners of the resulting triangles have been given blend radius 235-1, 235-2, 235-3 and 235-4. As will be appreciated, the blend radius avoids sharp corners in the resulting structure to facilitate easier manufacturing thereof. Rotated rectangle 205, shown in solid grey, has at least three filter response parameters kr 215, kp 220 and kn 225 which define a rotation (kr 215) and width (kn 225 and kp 220, respectively) of rectangle 205. When the rotation parameter, i.e., kr 215, is around 45 degrees (as shown in FIG. 2), a balanced roll-off on either side of the passband is achieved. As kr rotates away from 45 degrees, more roll-off can be achieved on one side of the passband at the expense of the other.

Figure 3:
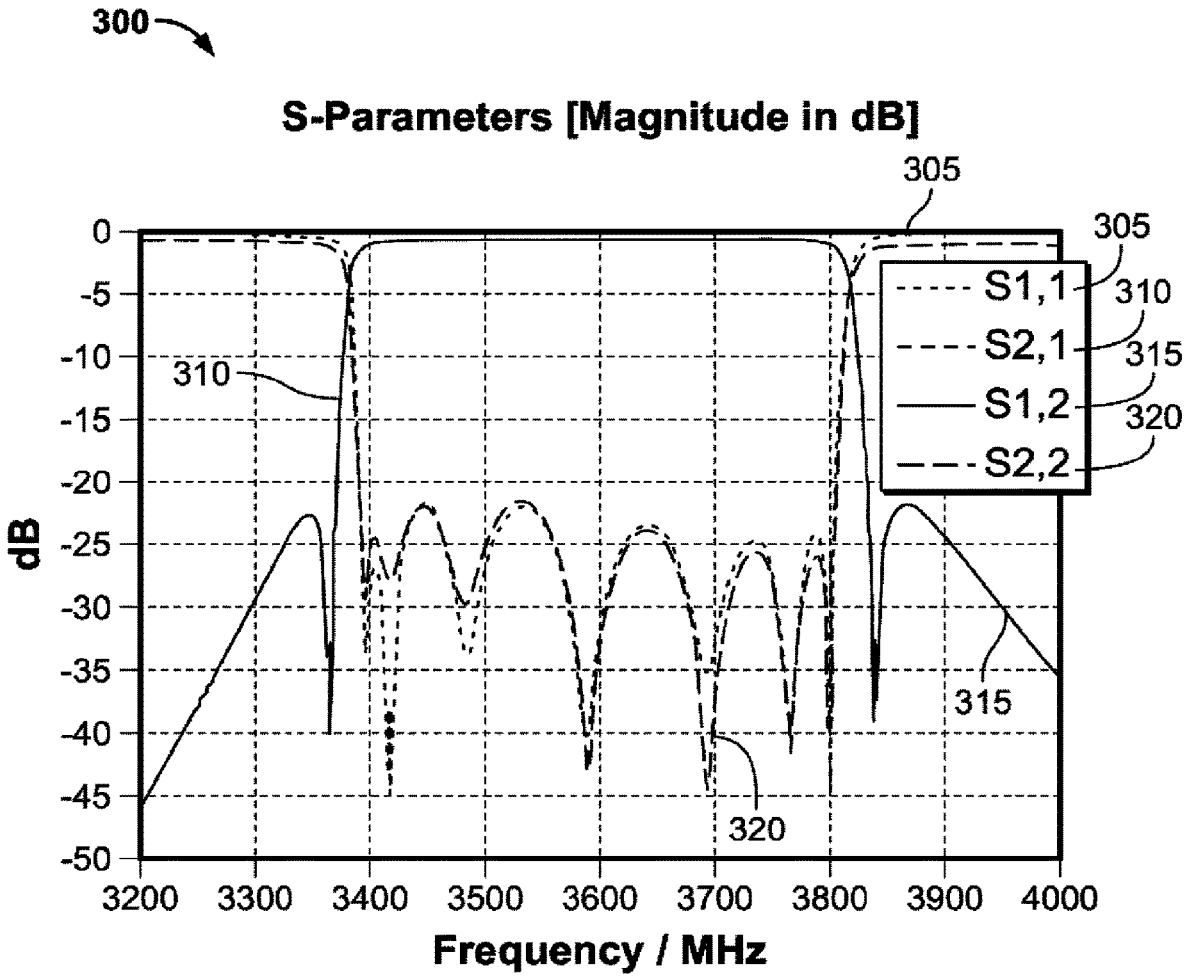
FIG. 3 shows an illustrative filter response from the multi-mode filter configured in accordance with FIGS. 1 and 2.

As noted above, kp 220 and kn 225 collectively define the width of rectangle 205 from center 230 of the slab/cube interface (i.e., interface 130). As shown in the FIG. 2, the respective width parameters are measured, illustratively, from a centerline through center 230. In this way, a smaller kp value results in a larger triangular aperture (e.g., aperture segment 110-2) whereas a larger kn value results in a smaller triangular aperture segment 110-2. Similarly, a small kn results in a larger triangular aperture (e.g., aperture segment 110-3) while a larger kn value results in a smaller triangular aperture for aperture segment 110-3. Further, the ratio of kp/kn dictates the selectivity of the multi-mode filter. A small kp value and a large kn value allows a well-known Chebyshev filter or similar filter with slow roll-off, and as kn decreases and approaches kp, the selectivity of the filter increases with the transmission zeros coming in towards the passband. The three filter response parameters for the filter response shown in FIG. 3 are kp 220=4.1 mm, kn 225=5.0 mm and kr 215=37 degrees from the vertical x-axis. The apertures as shown (i.e., aperture segments 110-2 and 110-3) produce the filter response from multi-mode filter 100 as shown in FIG. 3 which is discussed further herein below.

In accordance with the embodiment, as shown in FIG. 1, resonator body 105-3 (e.g., a triple mode cuboid) has three modes, the frequencies of which span the filter passband. Aperture segment 110-2 (i.e., a triangular aperture defined and configured as detailed above) allows for an approximately equal coupling from resonator 105-2/Slab $S_2$ to all three of the aforementioned cuboid modes of resonator body 105-3. This results in a very slow roll-off on either side of the filter passband. To increase selectively of the filter, aperture segment 110-3 constructively (i.e., in-phase) couples Slab $S_3$ to the middle mode of the cuboid, but destructively (i.e., out-of-phase) couple Slab $S_3$ to the low and high modes, respectively, of the cuboid. Thus, in accordance with the embodiment, the definition and configuration of aperture segment 110-2 increases the roll-off on either side of the passband thereby increasing filter selectivity and brings two points of perfect cancellation (i.e., transmission zeros) nearer to the passband as aperture segment 110-3 increases in size (or the width value of kn 225 decreases, as described above).

Advantageously, in accordance with the embodiment, the modes of the multi-mode structure are assumed to be coupled in parallel from input to output, with no coupling between the modes. In this way, defects are not needed in the shape of the body and allow this filter-type to use a perfect cuboid. Transmission zeros are formed by the amplitude and phase ratios of the parallel couplings into the modes, rather than by non-adjacent cross couplings across the resonators.

As shown in FIG. 3, filter response 300 include curves 305, 310, 315, and 320 which show the ratio of energy in decibels (dB) reflected off each filer port. These curves (it will be noted that curves 310 and 315 are identical and overlayed with one another in FIG. 3) show and represent enhanced filter selectively in accordance with the embodiment. That is, very little energy is transmitted through multi-mode filter 100 below 3380 MHz and above 3820 MHz while very little energy is lost through such filter between 3400 and 3800 MHz. Given the amount of reflected energy is small (>−20 dB) between 3400 and 3800 MHz, the small amount of transmission loss that is shown (mainly between the band edges) is due to material resistive dissipation (i.e., insertion loss).

Figure 4:
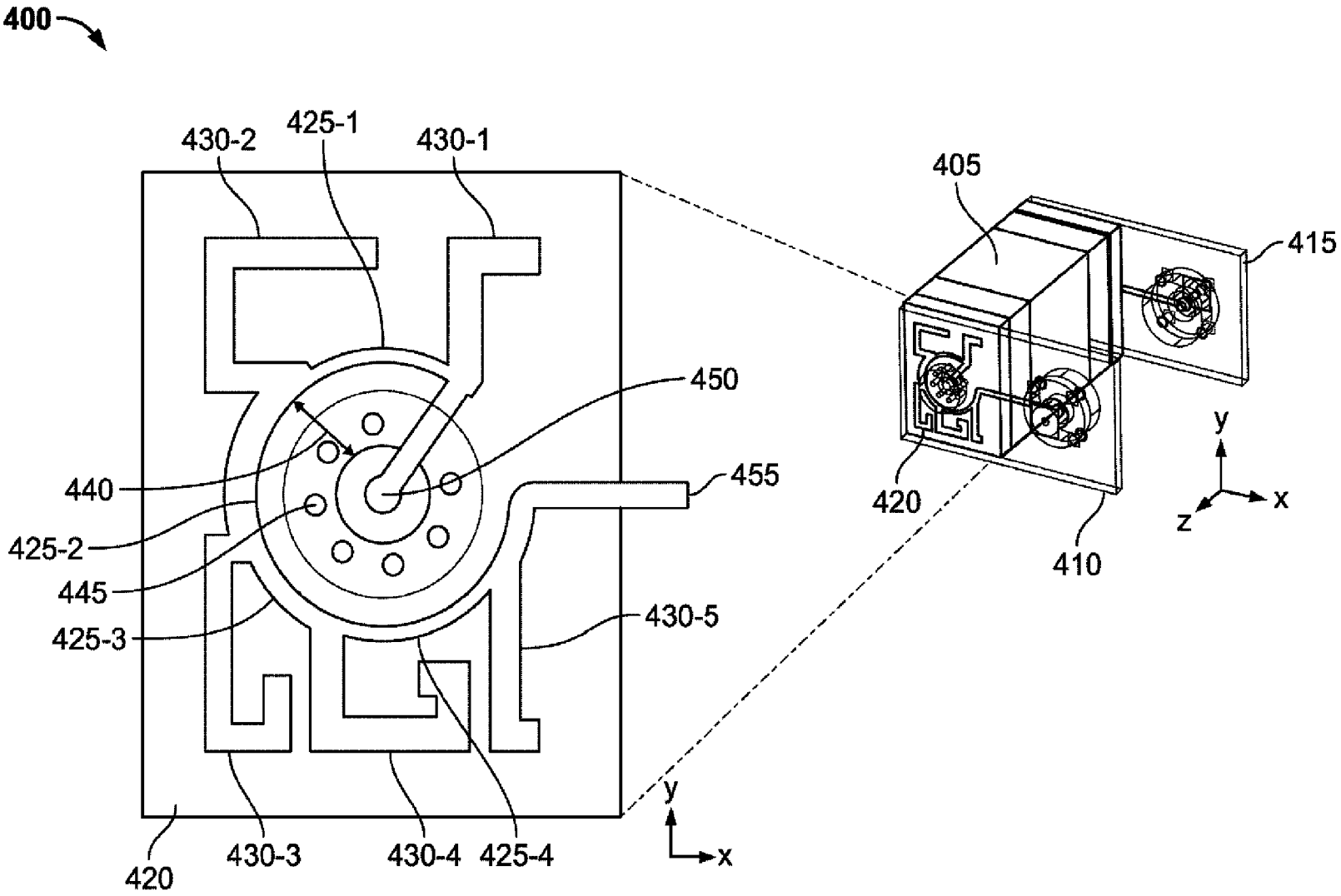
FIG. 4 shows a layout optimization having multi-mode filter configured with an integrated low pass filter in a printed circuit board in accordance with embodiment.

FIG. 4 shows a layout optimization having a multi-mode filter configured with an integrated low pass filter in a printed circuit board in accordance with embodiment. As shown, layout 400 comprises multi-mode filter 405 which is configured similarly as multi-mode filter 200, as detailed above, which is integrated with printed circuit board (PCB) 410 and printed circuit board 415. In accordance with the embodiment, PCB 410 has an integrated low pass filter 420 embedded as a strip-line therein having output 455. Illustratively, PCB 410 is a double layer board having an overall size of 15×12 mm. Input 450 to the low-pass filter is the output from the last resonator segment/Slab in multi-mode filter 405 (e.g., resonator body 105-5/Slab $S_5$) which extends radially outward to connect to reflection resonator 430-1 which is one of a plurality of such reflection resonators (the others being 430-2, 430-3, 430-3, 430-4 and 430-5) as shown in the FIG. 4. Further, in-band transmission resonators 425-1, 425-2, 425-3 and 425-4 wrap around input 455 in a circular arc configuration as separated (i.e., separation 440) by the plurality of reflection resonators. In this way, transmission resonators 425-1, 425-2, 425-3 and 425-4 maintain an adequate distance (approximately 3 mm) from input 455 in order to maintain a high degree of isolation which is further enhanced, in accordance with the embodiment, using grounded vias 445.

In accordance with the embodiment, the layout 400 minimizes insertion loss while maximizing isolation in the given footprint. That is, low pass filter 420 allows for minimizing insertion loss while maximizing isolation by having a high degree of pole zero flexibility. These "poles", in accordance with the embodiment, are associated with and derived from the four in-band transmission resonators 425-1, 425-2, 425-3 and 425-4. In turn, the "zeros" are associated with and derived from the five reflection resonators 430-1, 430-2, 430-3, 430-3, 430-4 and 430-5. As will be appreciated, this configuration provides for a parameterized degrees of freedom (i.e., track widths and lengths) such that, using optimization, the four poles can be positioned to maximize the bandwidth of low pass filter 420 (i.e., minimize insertion loss) while the zeros can be positioned to maximize attenuation only, as needed.

Figure 5:
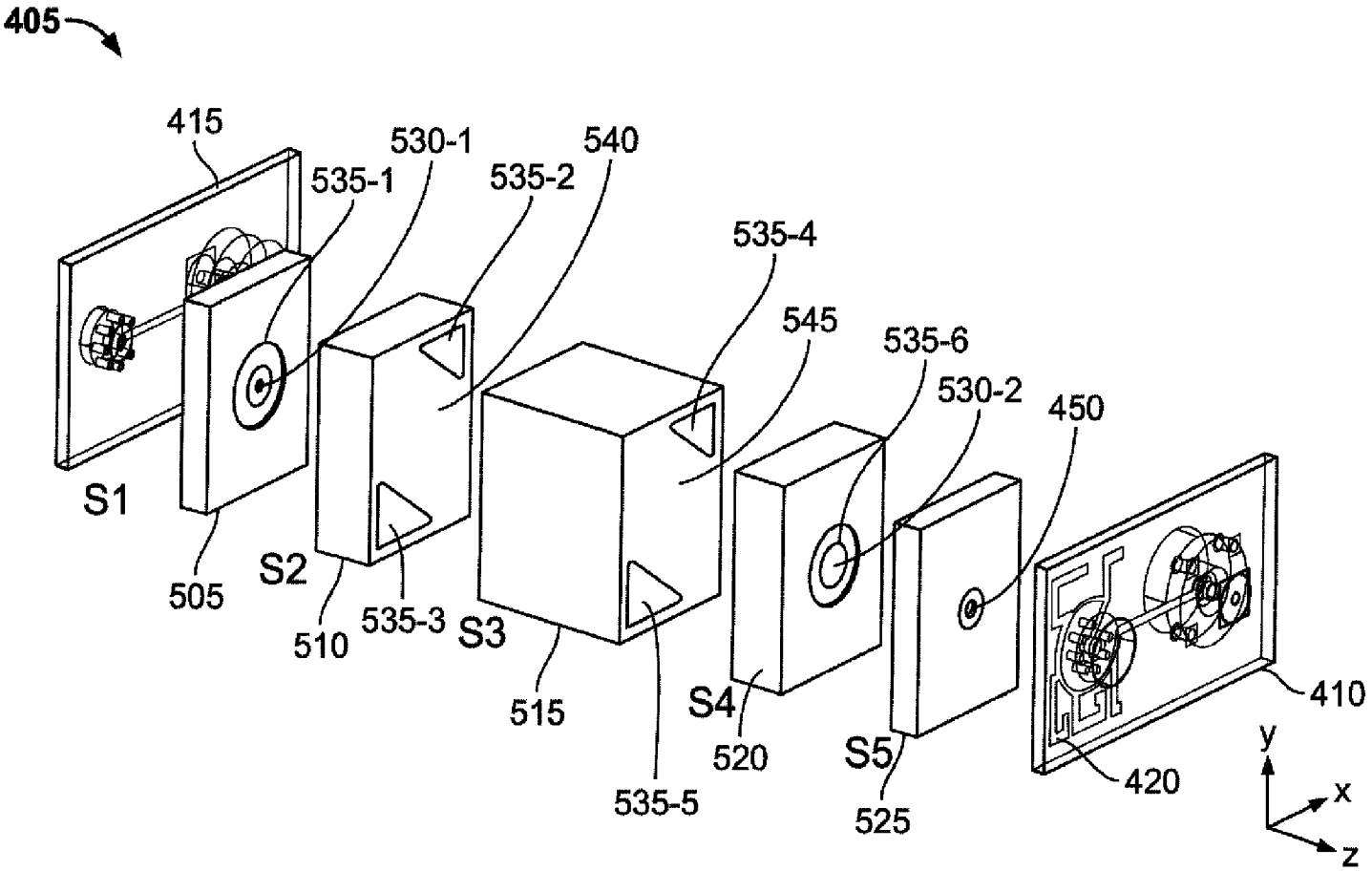
FIG. 5 shows a schematic perspective view of the multi-mode filter shown in FIG. 4 in accordance with an embodiment.

FIG. 5 shows a schematic perspective view of multi-mode filter 405 shown in FIG. 4 in accordance with an embodiment. In particular, multi-mode filter 405 comprises a plurality of resonator bodies (i.e., resonator bodies 505, 510, 515, 520 and 525; which are also identified in the Figure as Slabs $S_1$, $S_2$, $S_3$, $S_4$ and $S_5$, respectively) which are rectangular prisms (i.e., cuboids). Multi-mode filter 405 has through hole 530-1 which connects an input (not shown) received from printed circuit board 415 to the center of aperture segment 535-1 between the pair of slabs $S_1$ and $S_2$. Similarly, through hole 530-2 connects output 450 to the center of aperture segment 535-6 (the "bullseye" coupling structure previously described) between the pair of slabs $S_5$ and $S_4$ and ultimately output to printed circuit board 410 integrated with low pass filter 420. As detailed above, this resonator structure can be described as an end-tapped dumbbell-shaped half-wavelength low-Q resonator with a considerable increase in the amount of external coupling available.

Multi-mode filter 405 also comprises a plurality of coupling aperture segments (i.e., aperture coupling segments 535-1, 535-2, 535-3, 535-4, and 535-5, respectively) which are coupling structures between each pair of resonator bodies or slabs, as detail above. In the configuration shown in FIG. 5, the two triangular apertures at opposite corners of each slab-cube interface (i.e., interface 540 and interface 545) are employed with aperture segment 535-2 and aperture segment 535-3 configured in interface 540 (i.e., the slab-cube interface between Slab $S_2$ and Slab $S_3$) with such triangular apertures being diagonally opposed to one another, and aperture segment 535-4 and aperture segment 535-5 configured in interface 545 (i.e., the slab-cube interface between Slab $S_3$ and Slab $S_4$) with such triangular apertures being diagonally opposed to one another.

Figure 6:
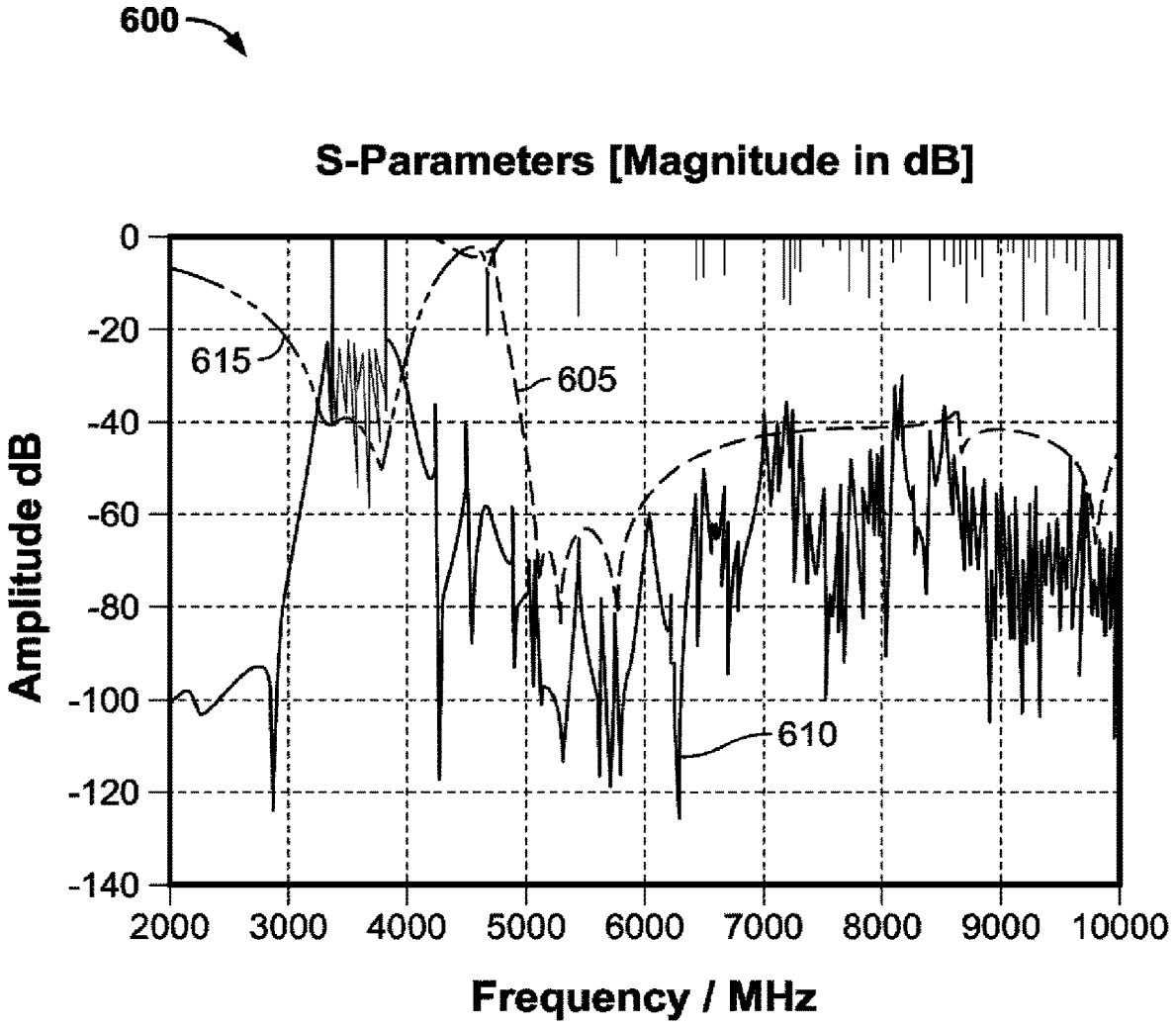
FIG. 6 shows an illustrative filter response from the multi-mode filter configured with the integrated low pass filter in the printed circuit board of FIG. 5.

FIG. 6 shows an illustrative filter response 600 from the multi-mode filter configured with the integrated low pass filter in the printed circuit board of FIG. 5. As shown, filter response 600 illustrates certain of the advantages of this embodiment configuration such as the blocking of spurious filter modes of the multi-mode filter (illustratively, a ceramic filter) as demonstrated by low pass filter response 605. In low pass filter response 605, there are three low pass filter transmission zeros from 5000 MHz to 6000 MHz to achieve a 65 dB attenuation specification. Without low pass filter 420, a combined response 610 would pass all of such spurious spikes close to zero dB above 5000 MHz. Further, reflection response 615 of low pass filter 420 is low enough in the passband such that the effect on the combined response 610 is minimal in the passband. That is, low pass filter 420 is basically transparent from 3400 to 3800 MHz but block everything above 5000 MHz.

The foregoing Detailed Description is to be understood as being in every respect illustrative and exemplary, but not restrictive, and the scope of the disclosure herein is not to be determined from the Detailed Description, but rather from the claims as interpreted according to the full breadth permitted by the patent laws. It is to be understood that the embodiments shown and described herein are only illustrative of the principles of the present disclosure and that various modifications may be implemented by those skilled in the art without departing from the scope and spirit thereof. Those skilled in the art could implement various other feature combinations without departing from the scope and spirit of the disclosure.

What is claimed is:

1. A multi-mode filter, comprising:

a plurality of resonator bodies, each resonator body from the plurality of the resonator bodies comprising a dielectric material, the plurality of resonator bodies comprising at least:

a first resonator body adjacent to a second resonator body;

a third resonator body adjacent to the second resonator body;

a fourth resonator body adjacent to the third resonator body;

a fifth resonator body adjacent to the fourth resonator body;

a plurality of coupling aperture segments, each coupling aperture segment configured to serve as a coupling between a respective pair of resonator bodies;

a first through hole for connecting an input of the multi-mode filter to a first coupling aperture segment of the plurality of coupling aperture segments, the first coupling aperture segment configured to couple the respective pair of resonator bodies comprising the first resonator body and the second resonator body;

a second through hole for connecting an output of the multi-mode filter to a second coupling aperture segment of the plurality of coupling aperture segments, the second coupling aperture segment coupling the respective pair of resonator bodies comprising the fourth resonator body and the fifth resonator body;

a first layer of electrically conductive material in contact with and covering the second resonator body and the third resonator body, the first layer of electrically conductive material extending along a first interface between the second resonator body and the third resonator body, the first interface having a set of four corners defining a boundary thereof; and wherein a third coupling aperture segment and a fourth coupling aperture segment are configured in the first layer of electrically conductive material at the first interface between the second resonator body and the third resonator body, the third coupling aperture segment and the fourth coupling aperture segment being the only coupling aperture segments in the first interface, and each having a triangular shape with the third coupling segment positioned in a first corner of the first interface and the fourth coupling segment positioned in a second corner of the first interface such that the third coupling aperture segment and the fourth coupling aperture segment are diagonally opposed to one another.

2. The multi-mode filter of claim 1 further comprising:

a second layer of electrically conductive material in contact with the fourth resonator body, the second layer of electrically conductive material extending along a second interface between the third resonator body and the fourth resonator body, the second interface having a set of four corners defining a boundary thereof; and wherein a fifth coupling aperture segment and a sixth coupling aperture segment are configured in the second layer of electrically conductive material at the second interface between the third resonator body and the fourth resonator body, the fifth coupling aperture segment and the sixth coupling aperture segment each having a triangular shape with the fifth coupling aperture segment positioned in a first corner of the second interface and the sixth coupling aperture segment positioned in a second corner of the second interface such that the fifth coupling aperture segment and the sixth coupling aperture segment are diagonally opposed to one another.

3. The multi-mode filter of claim 2 further comprising:

a connection with a low-pass filter.

4. The multi-mode filter of claim 3 wherein the low-pass filter is embedded as a strip-line configuration in a printed circuit board.

5. The multi-mode filter of claim 4 wherein the strip-line configuration comprises a plurality of in-band transmission resonators and a plurality of out-of-band reflection resonators.

6. The multi-mode filter of claim 5 wherein the fifth resonator body provides the output from the multi-mode filter as input to the low-pass filter by connecting with a particular one of the out-of-band reflection resonators.

7. The multi-mode filter of claim 6 wherein the plurality of out-of-band reflection resonators are maintained at a distance from the output provided by the fifth resonator body.

8. The multi-mode filter of claim 7 wherein the plurality of in-band transmission resonators wrap around the input in circular arcs separated by the plurality of out-of-band reflection resonators.

9. The multi-mode filter of claim 1 wherein each resonator body of the plurality of resonator bodies are cuboids.

10. The multi-mode filter of claim 1 wherein the first resonator body, the second resonator body, the fourth resonator body and the fifth resonator body each have a single resonance mode, and the third resonator body has multiple resonance modes.

11. The multi-mode filter of claim 1 wherein the plurality of resonator bodies are arranged to form a single resonator having multiple resonant modes.

12. The multi-mode filter of claim 11 wherein the first resonator body is operable to control an electric field and a magnetic field of a particular one of the multiple resonator modes.

13. The multi-mode filter of claim 11 wherein the single resonator is an end-tapped dumbbell-shaped half-wavelength low-Q resonator.

14. The multi-mode filter of claim 11 wherein the first resonator body and the fifth resonator body are operatively coupled to contain an electric field and a magnetic field associated with the single resonator.

15. The multi-mode filter of claim 1 wherein the third coupling aperture segment and the fourth coupling aperture segment are configured using at least three filter response parameters with one of the filter response parameters defining a rotation, and two others of the filter response parameters defining a width, of the third coupling aperture segment and the fourth coupling aperture segment.

16. The multi-mode filter of claim 15 wherein the filter response parameter defining the rotation equals 37 degrees from a vertical x-axis, and the two others of the filter response parameters defining the width equal 4.1 mm and 5.0 mm, respectively.

17. The multi-mode filter of claim 1 wherein the plurality of coupling aperture segments control a degree of coupling to different resonator modes defined by the plurality of resonator bodies.

18. The multi-mode filter of claim 1 wherein the dielectric material is ceramic.

19. A multi-mode filter, comprising:

a plurality of resonator bodies, each resonator body from the plurality of the resonator bodies comprising a dielectric material, the plurality of resonator bodies comprising at least:

a first resonator body adjacent to a second resonator body;

a third resonator body adjacent to the second resonator body;

a fourth resonator body adjacent to the third resonator body;

a fifth resonator body adjacent to the fourth resonator body;

a plurality of coupling aperture segments, each coupling aperture segment configured to serve as a coupling between a respective pair of resonator bodies;

a first through hole for connecting an input of the multi-mode filter to a first coupling aperture segment of the plurality of coupling aperture segments, the first coupling aperture segment configured to couple the respective pair of resonator bodies comprising the first resonator body and the second resonator body;

a second through hole for connecting an output of the multi-mode filter to a second coupling aperture segment of the plurality of coupling aperture segments, the second coupling aperture segment coupling the respective pair of resonator bodies comprising the fourth resonator body and the fifth resonator body;

a first layer of electrically conductive material in contact with and covering the second resonator body and the third resonator body, the first layer of electrically conductive material extending along a first interface between the second resonator body and the third resonator body, the first interface having a set of four corners defining a boundary thereof, and wherein a third coupling aperture segment and a fourth coupling aperture segment are configured in the first layer of electrically conductive material at the first interface between the second resonator body and the third resonator body, the third coupling aperture segment and the fourth coupling aperture segment each having a triangular shape with the third coupling segment positioned in a first corner of the first interface and the fourth coupling segment positioned in a second corner of the first interface such that the third coupling aperture segment and the fourth coupling aperture segment are diagonally opposed to one another, and wherein the first coupling aperture segment coupling the respective pair of resonator bodies comprising the first resonator body and the second resonator body is positioned such that a portion thereof covers a center portion of the first resonator body.

20. A multi-mode filter, comprising:

a plurality of resonator bodies, each resonator body from the plurality of the resonator bodies comprising a dielectric material, the plurality of resonator bodies comprising at least:

a first resonator body adjacent to a second resonator body;

a third resonator body adjacent to the second resonator body;

a fourth resonator body adjacent to the third resonator body;

a fifth resonator body adjacent to the fourth resonator body;

a plurality of coupling aperture segments, each coupling aperture segment configured to serve as a coupling between a respective pair of resonator bodies;

a first through hole for connecting an input of the multi-mode filter to a first coupling aperture segment of the plurality of coupling aperture segments, the first coupling aperture segment configured to couple the respective pair of resonator bodies comprising the first resonator body and the second resonator body;

a second through hole for connecting an output of the multi-mode filter to a second coupling aperture segment of the plurality of coupling aperture segments, the second coupling aperture segment coupling the respective pair of resonator bodies comprising the fourth resonator body and the fifth resonator body;

a first layer of electrically conductive material in contact with and covering the second resonator body and the third resonator body, the first layer of electrically conductive material extending along a first interface between the second resonator body and the third resonator body, the first interface having a set of four corners defining a boundary thereof, and wherein a third coupling aperture segment and a fourth coupling aperture segment are configured in the first layer of electrically conductive material at the first interface between the second resonator body and the third resonator body, the third coupling aperture segment and the fourth coupling aperture segment each having a triangular shape with the third coupling segment positioned in a first corner of the first interface and the fourth coupling segment positioned in a second corner of the first interface such that the third coupling aperture segment and the fourth coupling aperture segment are diagonally opposed to one another, and wherein the second coupling aperture segment coupling the respective pair of resonator bodies comprising the fourth resonator body and the fifth resonator body is positioned such that a portion thereof covers a center portion of the fifth resonator body.

* * * * *